United States Patent [19]

Mascher

[11] 4,155,361

[45] May 22, 1979

[54] AIR REGENERATING APPARATUS

[75] Inventor: Werner Mascher, Berlin, Fed. Rep. of Germany

[73] Assignee: Auergesellschaft GmbH, Berlin, Fed. Rep. of Germany

[21] Appl. No.: 831,483

[22] Filed: Sep. 8, 1977

[30] Foreign Application Priority Data

Sep. 10, 1976 [DE] Fed. Rep. of Germany ..... 2641366

[51] Int. Cl.[2] ..... A62B 7/00

[52] U.S. Cl. ..... 128/191 R; 128/147

[58] Field of Search ..... 128/191 R, 202, 142 R, 128/142.4, 142.3, 142.6, 146.6, 147, 145 R

[56] References Cited

U.S. PATENT DOCUMENTS

| | | | |
|---|---|---|---|
| 1,999,086 | 4/1935 | Claudius | 128/191 R |
| 2,889,210 | 6/1959 | Bovard | 128/191 R |
| 3,148,034 | 9/1964 | Bovard et al. | 128/191 R |
| 3,794,030 | 2/1974 | Cotabish et al. | 128/202 |
| 3,815,592 | 6/1974 | Staub, Jr. | 128/142 R |

FOREIGN PATENT DOCUMENTS

| | | | |
|---|---|---|---|
| 442585 | 4/1927 | Fed. Rep. of Germany | 128/191 R |
| 339755 | 4/1936 | Italy | 128/191 R |
| 483502 | 4/1938 | United Kingdom | 128/146 |

*Primary Examiner*—Henry J. Recla

*Attorney, Agent, or Firm*—Brown, Flick & Peckham

[57] ABSTRACT

A canister provided with openings for flow of air therethrough contains a chemical that removes water vapor and carbon dioxide from that air and liberates oxygen into it. After a period of time the flow of air through the canister is reversed.

4 Claims, 1 Drawing Figure

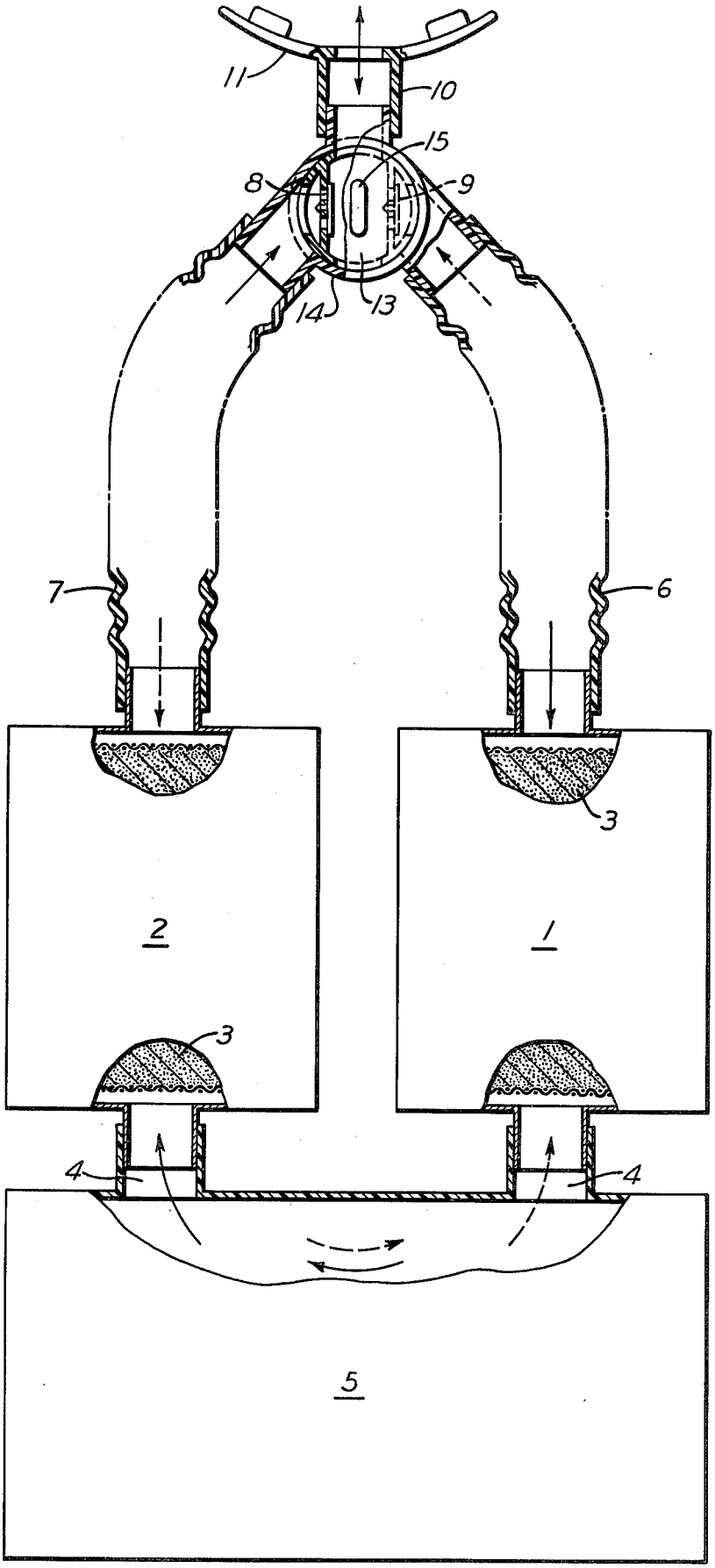
11
10
15
8
9
14
13
7
6
3
2
1
3
4
4
5

AIR REGENERATING APPARATUS

In closed circuit breathing apparatus of the circulatory type, in which the user inhales through one breathing tube and exhales through another, there generally is a canister filled with a chemical that removes or binds water vapor and carbon dioxide from the exhaled air and liberates oxygen into it, the generation of oxygen being due to the reaction of the water vapor and carbon dioxide with the chemical. The chemical used will bind carbon dioxide and water vapor for a longer period of time than it will produce oxygen in adequate amounts. After the canister has been used for a while, the chemical at the inlet end is no longer capable of developing oxygen in adequate amounts, although it can still bind carbon dioxide and water vapor. At the outlet end, on the other hand, the chemical is still in condition to liberate an adequate amount of oxygen, but in the conventional respirator the life of a chemical canister is determined by the condition of the chemical near its inlet end.

It is among the objects of this invention to provide an air regenerating apparatus which has a considerbly longer useful life than what has been known heretofore and yet which is hardly more complicated than the known apparatus.

The preferred embodiment of the invention is illustrated in the accompanying drawing, in which a front view of the apparatus is shown partly broken away in section.

Referring to the drawing, a pair of canisters 1 and 2 are each provided at their ends with inlet and outlet ports. Between these ports in each canister it is filled with a well known chemical 3, such as potassium superoxide, which will remove water vapor and carbon dioxide from air and liberate oxygen. The ports at one end of the two canisters are connected to openings 4 in a breathing bag 5. Connected to the other two ports of the canisters are two breathing tubes 6 and 7. These tubes are connected through an inlet valve 8 and an exhalation valve 9 with a mouthpiece tube 10 leading to a mouthpiece 11 or facepiece.

When a person exhales through the exhalation valve and tube 6 as shown by the solid arrow, the air passes down through the canister where carbon dioxide and water vapor are removed and oxygen is produced. The oxygen enriched air flows into the breathing bag, from which it is inhaled up through the other canister 2 and tube 7 and inhalation valve to the mouthpiece. This manner of using the apparatus can continue for a considerable length of time, but eventually canister 1 will stop liberating an adequate amount of oxygen.

A characteristic of this invention is that when that occurs the initially full breathing bag will relax and that will constitute for the user a consumption indication or a warning signal that his oxygen supply is decreasing. He then can reverse the respiratory flow in the system. There are a number of ways of reversing the flow, but it is highly desirable that the position of the different elements, except for the valves, not be changed. Accordingly, it is preferred that the two valves be mounted in opposite sides of a closed end cylinder 13 that is rotatable in a cylindrical housing 14. The cylinder and the housing are provided with openings registering with the two valves so that the inside of valve cylinder 13 is in communication with both tubes. Also, the valve cylinder and the top of housing 14 are provided with registering openings connecting the inside of the cylinder with the mouthpiece tube 10. The outer end of the valve cylinder is provided with a projection 15, by which the cylinder can be rotated in the housing to reverse the positions of the two valves. That is, the cylinder can be turned 180° to move the inhalation valve around to the adjoining end of breathing tube 6, and to move the exhalation valve into the position just vacated by the inlet valve. When this is done, the flow of air through the respirator will necessarily be in a direction indicated by the dotted arrows, which is opposite to what the flow was before.

During the flow in the direction of the solid arrows, most of the oxygen liberated came from canister 1. A much smaller amount was liberated by canister 2 because, since most of the water vapor and carbon dioxide was removed in the first canister, there was smaller chemical reaction in canister 2 to cause oxygen liberation. However, when the system is reversed, canister 2 becomes the main oxygen liberator, but oxygen also is liberated by the chemical at the bag end of canister 1. Also, by using two canisters, exhaled air enters directly into one of the canisters, regardless of direction of air flow, so the water vapor and temperature can be fully acted upon.

Although there are definite advantages in using two chemical canisters, it will be realized that this reversing flow invention can be practiced with only one canister, with both breathing tubes connected to the canister directly or with one of the two connected to it through a breathing bag. Also, the invention is not limited to breathing apparatus, but can be used for regenerating the air in a room by passing the air through the apparatus in first one direction and then, after a period of time, in the opposite direction.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Air regenerating apparatus comprising a mouthpiece, a canister provided with a pair of openings for flow of air therethrough, a chemical in the canister between said openings that removes water vapor and carbon dioxide from air flowing through the canister and liberates oxygen into that air, an inhalation valve and an exhalation valve communicating with the mouthpiece, a breathing tube connecting one of said canister openings with one of said valves, air-conducting means connecting the other canister opening with the other valve, whereby during exhalation air flows from the mouthpiece through the exhalation valve and through the canister in one direction and during inhalation air flows from the canister and through the inhalation valve to the mouthpiece, and manually operable means for shifting the positions of the valves while the apparatus is in use to reverse the direction of air flow through the canister and said breathing tube and air-conducting means.

2. Air regenerating apparatus according to claim 1, in which said air-conducting means include a breathing bag having a pair of openings into it, one of the bag openings being connected to said other canister opening, and the rest of said air-conducting means connect the other bag opening with said other valve.

3. Air regenerating apparatus according to claim 1, in which said air-conducting means include a second chemical-containing canister provided with a pair of openings, a breathing bag having a pair of openings into it, one bag opening being connected to said other opening of the first-mentioned canister, the other bag opening being connected with one of the second canister openings, and a second breathing tube connecting said other valve with the other opening in said second canister, whereby air flow is through one canister and then the breathing bag and then through the other canister.

4. Air regenerating apparatus comprising two canisters each provided with two openings for flow of air therethrough, a chemical in each canister between its openings that removes water vapor and carbon dioxide from air flowing through the canisters and liberates oxygen into that air, a breathing bag having a pair of openings into it, one bag opening being connected with one opening in one canister, the other bag opening being connected with one opening in the other canister, breathing tubes connected at one end with the other canister openings, a mouthpiece tube, a valve housing having openings therein connecting said mouthpiece tube with the other ends of said breathing tubes, an inhalation valve and an exhalation valve inside said valve housing at the openings therein connected with the breathing tubes, a support in said housing for said valves, and means for rotating said support in the housing to move the valves from a position in which the flow of air through said breathing tubes and canisters must be in one predetermined direction to a position in which the flow of air through the breathing tubes and canisters must be in the opposite direction.

* * * * *